US005085920A

United States Patent [19]

Nohr et al.

[11] Patent Number: 5,085,920

[45] Date of Patent: Feb. 4, 1992

[54] NONWOVEN WIPE HAVING IMPROVED GREASE RELEASE

[75] Inventors: Ronald S. Nohr, Roswell; J. Gavin MacDonald, Decatur, both of Ga.

[73] Assignee: Kimberly-Clark Corporation, Neenah, Wis.

[21] Appl. No.: 516,496

[22] Filed: Apr. 30, 1990

[51] Int. Cl.[5] ..... B32B 33/00; D04H 1/54; D04H 1/56; D04H 1/72

[52] U.S. Cl. ..... 428/198; 15/209 R; 428/288; 428/289; 428/296; 428/338

[58] Field of Search ..... 15/209 R; 428/198, 288, 428/289, 296, 338

[56] References Cited

U.S. PATENT DOCUMENTS

| | | | |
|---|---|---|---|
| Re. 31,885 | 5/1985 | Meitner | 252/91 |
| Re. 32,514 | 10/1987 | Steklenski | 524/32 |
| D. 239,566 | 4/1976 | Vogt | D59/2 R |
| D. 264,512 | 5/1982 | Rogers | D59/2 B |
| 3,016,599 | 1/1962 | Perry, Jr. | 28/78 |
| 3,704,198 | 11/1972 | Prentice | 161/148 |
| 3,755,527 | 8/1973 | Keller et al. | 264/210 F |
| 3,795,571 | 3/1974 | Prentice | 161/148 |
| 3,811,957 | 5/1974 | Buntin | 136/146 |
| 3,849,241 | 11/1974 | Buntin et al. | 161/169 |
| 3,855,046 | 12/1974 | Hansen et al. | 161/150 |
| 3,973,068 | 8/1976 | Weber | 28/198 |
| 3,978,185 | 8/1976 | Buntin et al. | 264/93 |
| 4,041,203 | 8/1977 | Brock et al. | 428/157 |
| 4,070,218 | 1/1978 | Weber | 156/167 |
| 4,100,324 | 7/1978 | Anderson et al. | 428/288 |
| 4,118,531 | 10/1978 | Hauser | 428/224 |
| 4,196,245 | 4/1980 | Kitson et al. | 428/198 |
| 4,298,649 | 11/1981 | Meitner | 428/198 |
| 4,307,143 | 12/1981 | Meitner | 252/91 |
| 4,328,279 | 5/1982 | Meitner et al. | 428/289 |
| 4,426,417 | 1/1984 | Meitner et al. | 428/195 |
| 4,436,780 | 3/1984 | Hotchkiss et al. | 428/198 |
| 4,493,868 | 1/1985 | Meitner | 428/171 |
| 4,578,414 | 3/1986 | Sawyer et al. | 524/310 |
| 4,587,154 | 5/1986 | Hotchkiss et al. | 428/195 |
| 4,659,777 | 4/1987 | Riffle et al. | 525/100 |
| 4,663,220 | 5/1987 | Wisneski et al. | 428/221 |
| 4,689,362 | 8/1987 | Dexter | 524/266 |
| 4,698,388 | 10/1987 | Ohmura et al. | 525/88 |
| 4,745,142 | 5/1988 | Ohwaki et al. | 524/87 |
| 4,873,101 | 10/1989 | Larson et al. | 426/113 |
| 4,904,521 | 2/1990 | Johnson et al. | 428/284 |
| 4,906,513 | 3/1990 | Kebbell et al. | 428/198 |
| 4,923,914 | 5/1990 | Nohr et al. | 524/99 |
| 4,940,626 | 7/1990 | Rhodes et al. | 428/198 |

FOREIGN PATENT DOCUMENTS

| | | |
|---|---|---|
| 1049682 | 4/1987 | Canada . |
| 0205242 | 12/1986 | European Pat. Off. . |
| 0343304 | 11/1989 | European Pat. Off. . |

OTHER PUBLICATIONS

Wente, *Industrial and Engineering Chemistry*, vol. 48, No. 8, pp. 1342–1346 (1956).

Wente et al., "Manufacture of Superfine Organic Fibers", Navy Research Lab., Washington, D.C., NRL Report 4364 (111437).

Buntin et al., *Journal of the Technical Association of the Pulp and Paper Industry*, vol. 56, No. 4, pp. 74–77 (1973).

*Chem. Abstr.*, 84:91066z (1976).

*Primary Examiner*—James C. Cannon

*Attorney, Agent, or Firm*—William E. Maycock

[57] ABSTRACT

A nonwoven wipe having improved grease release is provided which includes a meltblown polyolefin web having a basis weight of from about 17 to about 204 g/m$^2$, in which:

A. the meltblown polyolefin web has at or on the surfaces of the fibers thereof at least one additive having the general formula,

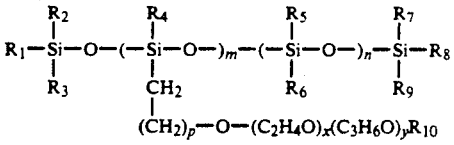

in which:

(1) $R_1$–$R_9$ are independently selected monovalent $C_1$–$C_3$ alkyl groups;

(2) $R_{10}$ is hydrogen or monovalent $C_1$–$C_3$ alkyl group;

(3) m represents an integer of from 1 to about 4;

(4) n represents an integer of from 0 to about 3;

(5) the sum of m and n is in the range of from 1 to about 4;

(6) p represents an integer of from 0 to about 5;

(7) x represents an integer of from 1 to about 10;

(8) y represents an integer of from 0 to about 5;

(9) the ratio of x to y is equal to or greater than 2;

(10) the additive has a molecular weight of from about 350 to about 1,400; and

(11) the additive is present in an amount of from about 0.5 to about 5 percent by weight, based on the amount of thermoplastic polyolefin; and B. the wipe has been pattern bonded by the application of heat and pressure in the ranges of from about 80° C. to about 180° C. and from about 150 to about 1,000 pounds per linear inch, respectively, employing a pattern with from about 10 to about 250 bonds/inch$^2$ covering from about 5 to about 30 percent of the wipe surface area.

16 Claims, No Drawings

NONWOVEN WIPE HAVING IMPROVED GREASE RELEASE

BACKGROUND OF THE INVENTION

The present invention relates to a nonwoven wipe. More particularly, the present invention relates to a nonwoven wipe having improved grease release.

As used herein, the term "wipe" is meant to include any product which is used to clean, polish, or dry any surface. Wipes are employed domestically and industrially for finishing, clean-up, polishing, drying, and like operations, including clean-up involving hand and face contact. In such uses, a wipe often must absorb water and/or oily materials. Additionally, a wipe employed in food service operations desirably also has the ability to release oils and grease upon application of moderate pressure as by hand wringing or squeezing. The terms "wipe" and "wiper" are used synonymously in the art, although the former term is preferred throughout this specification.

U.S. Pat. No. 4,298,649 to Meitner describes a nonwoven disposable wiper. The wiper results from a combination of meltblown microfiber web laminated to at least one web of interconnected aligned split filaments, such as a fibrillated thermoplastic film or foam. The laminate preferably is pattern bonded under the influence of heat and pressure. The laminate preferably contains an ionic or nonionic surfactant.

U.S. Pat. Nos. 4,307,143 and Re. 31,885 to Meitner disclose a microfiber oil and water wipe. A base material of meltblown synthetic, thermoplastic microfibers is treated with a wetting agent and may be pattern bonded in a configuration to provide strength and abrasion resistance properties while promoting high absorbency for both water and oil.

A clean room wiper is described in U.S. Pat. No. 4,328,279 to Meitner et al. A low linting, low sodium ion content wiper is obtained through the use of a treatment involving a mixture of wetting agents.

U.S. Pat. No. 4,493,868 to Meitner discloses a high bulk bonding pattern and method for materials particularly useful as wipers. A variety of materials apparently can be used, although meltblown and coformed polyolefin nonwoven webs appear to be preferred. The total bond area should not exceed 40 percent.

An oil and grease absorbent rinsable nonwoven fabric is described in U.S. Pat. No. 4,587,154 to Hotchkiss et al. The fabric has the capability to release at least about 60 percent of absorbed oil and grease under stated test conditions. The fabric preferably is a meltblown polypropylene web. The web is treated to contain from about 0.5 to 7.5 percent by weight of one or more of a film-forming composition. The web is pattern bonded, preferably in a pattern which covers up to about 30 percent of the surface area.

U.S. Pat. No. 4,906,513 to Kebbell et al. describes a nonwoven wiper laminate. The wiper is a combination of a relatively high basis weight center layer of meltblown thermoplastic microfibers having other fibers or particles mixed therein. On one side of the center layer there is a relatively lightweight layer of continuous filament thermoplastic fibers of larger diameter. On the other side there is a lightweight meltblown microfiber layer. All components are treated with a surfactant for wettability, and the combination is preferably bonded by a patterned application of heat and pressure.

In addition to the foregoing, U.S. Pat. No. 4,041,203 to Brock et al. relates to nonwoven fabrics and sterile wrapper materials made by combining layers of meltblown thermoplastic fibers with one or more continuous thermoplastic filament layers. The disclosure recognizes that such materials can be treated for absorbency and used in wiper applications. U.S. Pat. No. 4,196,245 to Kitson et al. relates to a composite nonwoven fabric useful in disposable surgical items and which can comprise one or more meltblown layers loosely bonded to one or more spunbonded layers.

The formation of fibers by meltblowing is well known in the art. See, by way of example, U.S. Pat. Nos. 3,016,599 to Perry, Jr., 3,704,198 to Prentice, 3,755,527 to Keller et al., 3,795,571 to Prentice, 3,811,957 to Buntin, 3,849,241 to Buntin et al., 3,978,185 to Buntin et al., 4,100,324 to Anderson et al., 4,118,531 to Hauser, and 4,663,220 to Wisneski et al. See, also, V. A. Wente, "Superfine Thermoplastic Fibers", *Industrial and Engineering Chemistry,* Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Buntin and Dwight T. Lohkamp, "Melt Blowing - A One-Step Web Process for New Nonwoven Products", *Journal of the Technical Association of the Pulp and Paper Industry,* Vol. 56, No.4, pp. 74–77 (1973). Composite materials including fibers and/or particulates incorporated in a meltblown fiber matrix are described in U.S. Pat. No. 4,100,324 to Anderson et al. A web of blended microfibers and crimped bulky fibers is disclosed in U.S. Pat. No. 4,118,531 to Hauser.

Wipers made from a matrix of meltblown fibers having incorporated therein a mixture of staple fibers including synthetic and cotton fibers are described in U.S. Pat. No. 4,426,417 to Meitner et al. Laminate wiper materials including a meltblown middle layer with or without other fibers mixed therein between spunbonded outer layers are described in U.S. Pat. No. 4,436,780 to Hotchkiss et al. A laminate material useful for wiping applications and including a layer of meltblown fibers having other fibers or particles mixed therein combined with at least one meltblown layer is described in published European Application No. 0205242.

Because many of the wipes described in the foregoing references utilize nonwoven webs prepared from inherently hydrophobic materials, some means of rendering the surfaces of such materials hydrophilic was necessary. The traditional approach has been to spray or coat the web with a surfactant solution during or after its formation. The web then must be dried, and the surfactant which remains on the web is removed upon exposure of the web to aqueous media. Alternatively, a surfactant can be included in the polymer which is to be melt-processed, as disclosed in U.S. Pat. Nos. 3,973,068 and 4,070,218 to R. E. Weber. However, the surfactant must be forced to the surface of the fibers from which the web is formed. This typically is done by heating the web on a series of steam-heated rolls or "hot cans". This process, called "blooming", is expensive and still has the disadvantage of ready removal of the surfactant by aqueous media. Moreover, the surfactant has a tendency to migrate back into the fiber which adversely affects shelf life, particularly at high storage temperatures. In addition, it is not possible to incorporate in the polymer levels of surfactant much above 1 percent by weight because of severe processability problems; surfactant levels at the surface appear to be limited to a maximum of about 0.33 percent by weight. Most importantly, the blooming process results in web shrinkage in the cross-machine direction and a significant loss in web tensile strength.

U.S. Pat. No. 4,578,414 to L. H. Sawyer and G. W. Knight describes wettable olefin polymer fibers. The fibers are formed from a composition comprising a polyolefin resin and one or more defined surface-active agents. The surfaceactive agents are stated to bloom to the fabricated fiber surfaces where at least one of the surface-active agents remains partially embedded in the polymer matrix. The patent further states that the permanence of wettability can be controlled through the composition and concentration of the additive package.

Polysiloxane/polyoxazolineblock copolymersare disclosed in U.S. Pat. No. 4,659,777 to J. S. Riffle and I. Yilgor. The copolymers are stated to be useful as surface-modifying additives for base polymers.

U.S. Pat. No. 4,689,362 to M. Dexter relates to stabilized olefin polymer insulating materials. Briefly, insulating material for electric wire and cable consists of an olefin polymer stabilized against electrical failure resulting from voltage stress by the presence therein of a polydialkylsiloxanepolyoxyalkylene block or graft copolymer.

U.S. Pat. No. 4,698,388 to H. Ohmura et al. describes a method for modifying the surface of a polymer material by means of a block copolymer. The block copolymer consists of a hydrophilic polymer portion formed from a vinyl monomer and a polymer portion which is compatible with the polymer material, also formed from a vinyl monomer.

A stainproof polyester fiber is described by U.S. Pat. No. 4,745,142 to S. Ohwaki et al. The fiber comprises at least one fiber-forming polyester copolymer comprising a backbone polyester polymer and at least one substituent which blocks at least a portion of the terminals of the molecules of the backbone polyester moiety. The substituent consists of a polyoxyalkylene glycol group.

Polymer compositions having a low coefficient of friction are described by U.S. Pat. No. Re. 32,514 to D. J. Steklenski. The compositions comprise a blend of at least 80 percent by weight of a polymer and at least 0.35 percent by weight of a cross-linked silicone polycarbinol.

Canadian Patent No. 1,049,682 describes the inclusion in a thermoplastic polymer of from 0.1 to 10 percent by weight of a carboxy-functional polysiloxane. Suitable thermoplastic polymers include polyolefins. See, also, German Published Patent Application (Offenlegungschrift) No. 2,506,667 [*Chem. Abstr.*, 84:91066z (1976)].

A significant improvement in the alteration of the surface characteristics of fibers and films prepared from thermoplastic polymers is represented by the surface-segregatable, melt-extrudable thermoplastic compositions described in commonly assigned application Ser. No. 07/181,359, entitled SURFACE-SEGREGATABLE, MELT-EXTRUDABLE THERMOPLASTIC COMPOSITION, filed on Apr. 14, 1988 in the names of Ronald S. Nohr and J. Gavin MacDonald, now U.S. Pat. No. 4,923,914, which patent is incorporated herein by reference.

The compositions described in the patent are particularly useful for the formation of nonwoven webs by such meltextrusion processes as meltblowing, coforming, and spunbonding. Upon being melt-extruded, such compositions result in a fiber having a differential, increasing concentration of the additive from the center to the surface thereof, such that the concentration of additive toward the surface of the fiber is greater than the average concentration of additive in the more central region of the fiber and imparts to the surface of the fiber at least one desired characteristic which otherwise would not be present.

When the additive was a siloxane-containing compound and the desired characteristic was water-wettability, however, the resulting nonwoven webs often became less wettable over time and frequently reverted to a nonwettable state. This loss of wettability, or aging, was accelerated when the polymer composition contained titanium dioxide. However, the absence of titanium dioxide did not prevent the aging which typically was complete within a matter of days.

It subsequently was discovered that the foregoing loss of wettability on aging can be avoided by forming the nonwoven web from a surface-segregatable, melt-extrudable thermoplastic composition which comprises at least one thermoplastic polyolefin and at least one additive having the general formula,

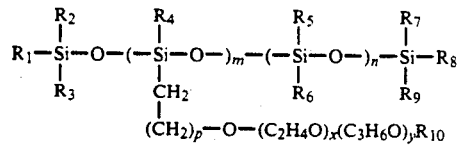

in which:

(A) $R_1$–$R_9$ are independently selected monovalent $C_1$–$C_3$ alkyl groups;

(B) $R_{10}$ is hydrogen or a monovalent $C_1$–$C_3$ alkyl group;

(C) m represents an integer of from 1 to about 4;

(D) n represents an integer of from 0 to about 3;

(E) the sum of m and n is in the range of from 1 to about 4;

(F) p represents an integer of from 0 to about 5

(G) x represents an integer of from 1 to about 10;

(H) y represents an integer of from 0 to about 5;

(I) the ratio of x to y is equal to or greater than 2;

(J) said additive has a molecular weight of from about 350 to about 1,400; and (K) said additive is present in an amount of from about 0.5 to about 5 percent by weight, based on the amount of thermoplastic polyolefin.

Such additive and a method for preparing a wettable nonwoven web which remains wettable after its formation for at least two years at ambient temperature are described and claimed in commonly assigned application Ser. No. 07/485,921, entitled SURFACE-SEGREGATABLE COMPOSITIONS AND NONWOVEN WEBS PREPARED THEREFROM, filed Feb. 27, 1990 in the names of Ronald S. Nohr and J. Gavin MacDonald. It now has been discovered that a wipe comprising a nonwoven web prepared in accordance with the teachings of such application has unexpectedly superior grease release.

SUMMARY OF THE INVENTION

It therefore is an object of the present invention to provide an improved nonwoven wipe.

It is further object of the present invention to provide an improved nonwoven wipe having unexpectedly superior grease release.

These and other objects will be apparent to those having ordinary skill in the art from a consideration of the specification and claims which follow.

Accordingly, the present invention provides a nonwoven wipe having improved grease release which comprises a meltblown polyolefin web having a basis weight of from about 17 to about 204 g/m$^2$, in which:

A. said meltblown polyolefin web has at or on the surfaces of the fibers thereof at least one additive having the general formula,

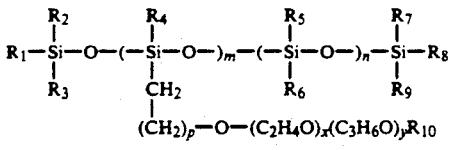

in which:

(1) $R_1$–$R_9$ are independently selected monovalent $C_1$–$C_3$ alkyl groups;
(2) $R_{10}$ is hydrogen or a monovalent $C_1$–$C_3$ alkyl group;
(3) m represents an integer of from 1 to about 4;
(4) n represents an integer of from 0 to about 3;
(5) the sum of m and n is in the range of from 1 to about 4;
(6) p represents an integer of from 0 to about 5;
(7) x represents an integer of from 1 to about 10;
(8) y represents an integer of from 0 to about 5;
(9) the ratio of x to y is equal to or greater than 2;
(10) said additive has a molecular weight of from about 350 to about 1,400; and
(11) said additive is present in an amount of from about 0.5 to about 5 percent by weight, based on the amount of thermoplastic polyolefin; and B. said wipe has been pattern bonded by the application of heat and pressure in the ranges of from about 80° C. to about 180° C. and from about 150 to about 1,000 pounds per linear inch, respectively, employing a pattern with from about 10 to about 250 bonds/inch$^2$ covering from about 5 to about 30 percent of the wipe surface area.

In one preferred embodiment, said meltblown polyolefin web is prepared from a surface-segregatable, melt-extrudable thermoplastic composition which comprises at least one thermoplastic polyolefin and at least one additive as defined above. In another preferred embodiment, said meltblown polyolefin web is coated after its formation with a grease release effective amount of at least one additive as defined above.

In other preferred embodiments, the polyolefin is polypropylene. In still other preferred embodiments, the meltblown polyolefin web is comprised of microfibers having average diameters of no more than about ten microns.

DETAILED DESCRIPTION OF THE INVENTION

The meltblown polyolefin web which comprises the wipe of the present invention has at or on the surfaces of the fibers thereof at least one additive. In general, the means by which such at least one additive is located at or on the surfaces of the fibers is not known to be critical.

As used herein, the phrase "at or on the surfaces of the fibers" means only that the at least one additive is present sufficiently near the surfaces of the fibers to both render the surfaces wettable by water, i.e., hydrophilic, and to give the web the improved grease release described herein. It is not necessary that additive be present solely on the surfaces of the fibers, e.g., at the fiber surface-air interface. That is, additive can be distributed throughout the bulk of the fibers, provided that some additive is located sufficiently close to the fiber surfaces to accomplish the foregoing two results. On the other hand, all of the additive can be present at the fiber surface-air interface, as will be the case when the additive is applied topically to the wipe after its formation. Thus, additive can be incorporated into the thermoplastic polymer prior to or during melt processing and/or applied topically to the wipe after its formation.

The additives which can be employed to prepare the wipe of the present invention are, as already noted, described in application Ser. No. 07/485,921. These additives come within the scope of those employed in U.S. Pat. No. 4,923,914, supra. Consequently, the additives which are useful in the present invention also function in the same way. That is, upon melt-extruding a mixture of a thermoplastic polyolefin and at least one additive as defined herein, fibers result which have a differential, increasing concentration of the additive from the center to the surfaces thereof, such that the concentration of additive toward the surfaces of the fibers is greater than the average concentration of additive in the more central regions of the fibers and imparts hydrophility to the fiber surfaces. As described in the patent, the surfaces of the fibers will be hydrophilic if sufficient additive is within about 15 Å of the interfacial surface, i.e., at the "effective" surface. It is this characteristic of the additives which permits their incorporation into the polymer prior to or during melt-extrusion.

Thus, in one preferred embodiment, the meltblown polyolefin web which comprises the wipe of the present invention is prepared from a surface-segregatable, melt-extrudable thermoplastic composition which comprises at least one thermoplastic polyolefin and at least one additive as defined herein. This method has the advantage of eliminating post-formation treatments which typically involve aqueous solutions, thereby eliminating a drying step.

In another preferred embodiment, the meltblown polyolefin web is coated after its formation with a grease release effective amount of at least one additive. This approach is particularly useful in mills which already have been equipped for a post-formation treatment involving aqueous solutions.

The use herein of the term "surface-segregatable" is consistence with its use in U.S. Pat. No. 4,923,914, supra. Upon melt-extruding such thermoplastic composition to form fibers, there is in such a fiber a differential, increasing concentration of the additive from the center to the surface thereof. The concentration of additive at or near the surface of the fiber is sufficient to render the normally hydrophobic polyolefin wettable by water, or hydrophilic. Unless stated otherwise, the term "hydrophilic" will be used herein to mean water-wettable. Thus, there is a controlled migration or segregation of additive toward the surface of the fiber which results in a controllable, differential concentration of additive in the fiber. Because the concentration of additive in the center portion of the fiber typically will vary nonlinearly from the concentration of the additive at or near the surface, this concentration difference is referred to herein as a differential concentration.

The term "melt-extrudable" is equivalent to "melt-processable" and is not intended to be limited in any way. That is, the term is intended to encompass the use of the composition in any melt-extrusion process which is or may be employed to prepare meltblown nonwoven webs, provided the process meets the limitations imposed by the claims.

In general, the term "thermoplastic polyolefin" is used herein to mean any thermoplastic polyolefin which can be used for the preparation of nonwoven webs. Examples of thermoplastic polyolefins include polyethylene, polypropylene, poly(1-butene), poly(2-butene), poly(1-pentene), poly(2-pentene), poly(3-methyl-1-pentene),poly(4-methyl-1-pentene),1,2-poly-1,3-butadiene, 1,4-poly-1,3-butadiene, polyisoprene, polychloroprene, polyacrylonitrile, poly(vinyl acetate), poly(vinylidene chloride), polystyrene, and the like.

The preferred polyolefins are those which contain only hydrogen and carbon atoms and which are prepared by the addition polymerization of one or more unsaturated monomers. Examples of such polyolefins include, among others, polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly1,3-butadiene, polyisoprene, polystyrene, and the like. In addition, such term is meant to include blends of two or more polyolefins and random and block copolymers prepared from two or more different unsaturated monomers. Because of their commercial importance, the most preferred polyolefins are polyethylene and polypropylene.

The additive employed has the general formula,

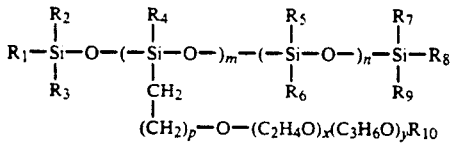

in which:

(1) $R_1$-$R_9$ are independently selected monovalent $C_1$-$C_3$ alkyl groups;
(2) $R_{10}$ is hydrogen or a monovalent $C_1$-$C_3$ alkyl group;
(3) m represents an integer of from 1 to about 4;
(4) n represents an integer of from 0 to about 3;
(5) the sum of m and n is in the range of from 1 to about 4;
(6) p represents an integer of from 0 to about 5;
(7) x represents an integer of from 1 to about 10;
(8) y represents an integer of from 0 to about 5;
(9) the ratio of x to y is equal to or greater than 2; and
(10) said additive has a molecular weight of from about 350 to about 1,400.

In preferred embodiments, each of $R_1$-$R_9$ is a methyl group. In other preferred embodiments, $R_{10}$ is either hydrogen or a methyl group. In yet other preferred embodiments, m is either 1 or 2. In still other preferred embodiments, p is either 1 or 2, but most preferably is 2. In yet other preferred embodiments, y is 0 and x is 7 or 8.

Preferably, n will be 0, in which case the additive will have the general formula,

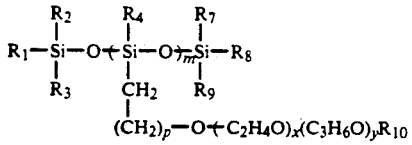

in which each of $R_1$-$R_4$, $R_7$-$R_9$, m, p, x, and y are as already defined.

Although the additive molecular weight can vary from about 350 to about 1,400, it preferably will not exceed about 1,000. Most preferably, the molecular weight will be in the range of from about 350 to about 700.

While the additive can be either a liquid or a solid, a liquid is preferred. It also is preferred that a liquid additive have a surface tension which is less than that of virgin polymer; the lower surface tension assures that the additive will be more likely to completely "wet" or cover the surface of the fiber or film as the segregation process proceeds to completion, especially under conditions favoring a large concentration differential.

In general, when additive is incorporated into the polymer prior to or during melt-extrusion, the additive will be present in an amount of from about 0.5 to about 5 percent by weight, based on the amount of thermoplastic polyolefin. As a practical matter, additive levels of from about 0.7 to about 3 percent by weight are preferred.

When additive is applied to the web in a post-formation treatment, add-on levels typically will be in the range of from about 0.3 to about 1.5 percent by weight, based on the dry weight of the web (i.e., on a dry weight basis). Preferably, the add-on level will be in the range of from about 0.5 to about 1.0 percent by weight.

In general, any known method can be used to apply additive to the web after its formation. Additive typically will be applied in solution, which solution can be aqueous or nonaqueous. Because of environmental considerations, the use of aqueous solutions is preferred. The amount of additive in such a solution is not critical and can vary over a wide range. As a practical matter, solutions containing from about 1 to about 10 percent by weight will be employed. Application of the solution to the web can be by any convenient method, such as by spraying, dipping, and the like.

The term "additive" is used broadly herein to encompass the use of more than one additive in a given composition, i.e., a mixture of two or more additives. Moreover, it should be appreciated by those having ordinary skill in the art that additives as defined herein typically are not available as pure compounds. Thus, the presence of impurities or related materials which may not come within the general formula given above for the additives does remove any given material from the spirit and scope of the present invention. For example, the preparation of additives useful in the present invention typically results in the presence of free polyether. The presence of such free polyether is not known to have deleterious effects, although it may be necessary to increase the amount of additive to compensate for the presence of free polyether. As a practical matter, it is preferred that the amount of free polyether present in any additive be no more than about 30 percent by weight. More preferably, the amount of free polyether present in an additive will be no more than about 20 percent by weight.

The basis weight of the nonwoven meltblown web typically will be in the range of from about 17 to about 204 g/x$^2$. Preferably, the basis weight of the web will be in the range of from about 34 to about 140 g/x$^2$.

Finally, the wipe is pattern bonded by the application of heat and pressure in the ranges of from about 80° C. to about 180° C. and from about 150 to about 1,000 pounds per linear inch (59–178 kg/cm), respectively, employing a pattern with from about 10 to about 250 bonds/inch$^2$ (1–40 bonds/cm$^2$) covering from about 5 to about 30 percent of the wipe surface area. Such pattern bonding is accomplished in accordance with known procedures. See, for example, U.S. Design Pat. No. 239,566 to Vogt, U.S. Design Pat. No. 264,512 to Rogers, U.S. Pat. No. 3,855,046 to Hansen et al., and U.S. Pat. No. 4,493,868, supra, for illustrations of bonding patterns and a discussion of bonding procedures.

Although the nonwoven wipe of the present invention has been described with respect to the single meltblown polyolefin web of which it is comprised, the wipe can be a multilayer composite or laminate. For example, two layers can be employed. One layer will be the meltblown web already described and the other layer can be either a meltblown web or a spunbonded web. Alternatively, both layers can be the meltblown web already described. Moreover, any meltblown web present in the wipe can have distributed therein fibers or particles in accordance with the disclosure of U.S. Pat. No. 4,100,324, supra.

The wipe also can consist of three layers. One layer will be the meltblown web already described and the other two layers can be meltblown or spunbonded layers. The meltblown layer already described can be the center web or one of the outside webs. In addition, two or more layers can be the meltblown web already described. When the center layer is the meltblown web already describe, both outside layers conveniently can be spunbonded layers. Other combinations and numbers of layers are contemplated by the present invention and are deemed to come within the scope of the claims.

The present invention is further described by the examples which follow. Such examples, however, are not to be construed as limiting in any way either the spirit or scope of the present invention. In the examples, all temperatures are in degrees Celsius and all parts are by weight unless stated otherwise. In addition, the term "additive" is used to include both a single material and a mixture of two materials as was employed in several of the examples.

EXAMPLES 1–9

Nine meltblown webs were prepared generally in accordance with the process described in U.S. Pat. No. 3,978,185, which patent is incorporated herein by reference in its entirety. The thermoplastic polyolefin employed was Type PF-301 polypropylene (Himont Incorporated, Wilmington, Del.). According to the manufacturer, the polymer has a melt flow rate of 35 g/10 minutes. The number-average molecular weight is 50,000 and the weight-average molecular weight is 150,000. Thus, the polydispersity of the polymer is 3.0.

The polymer was extruded at a rate of 2.5 lbs per inch per hour (0.45 kg per cm per hour) and collected at a distance of 14 inches (36 cm) on a forming screen. The basis weight of each web was of the order of 73–76 g/m$^2$. Each web was pattern bonded with the pattern of U.S. Design Pat. No. 264,512, supra, essentially as described in U.S. Pat. No. 3,855,046, supra. The bonding area of the resulting wipe was about 30 percent.

Additive was applied topically as an aqueous solution to four of the wipes by either of two methods. In method A, additive was applied continuously to the web immediately after its formation by a quench spray in an amount sufficient to give an add-on on a dry weight basis of 0.8–1.0 percent. In method B, a square wipe having 12-inch (30.5-cm) sides was dipped for ten seconds into an aqueous solution of 3 weight percent additive in tap water. Excess water was removed by running the web through an Atlas wringer having a nip pressure of 10 lbs (4.5 kg). The resulting wipe then was dried in a convection oven at 120° F. (49° C.) for 30 minutes. The amount of additive on the dried fabric typically was about 0.7 percent by weight.

In the remaining five wipes, additive was incorporated into the polymer during melt-extrusion, in which case the polymer and additive were simply mixed mechanically before introducing the mixture to the feed hopper of the extruder. Typically, a standard portable cement mixer was charged with 50 pounds of the polymer in pellet form. The mixer then was started and charged with the desired amount of additive. Mixing was allowed to continue for 20 minutes, after which time the mixture was removed from the mixer and stored in plastic-lined boxes.

Additives were prepared from the six compounds described below.

Compound I

Compound I was an isooctylph-enylpolyethoxyethanol surfactant (TRITON® X-102, Rohm and Haas, Philiadelphia, Pa.).

Comoound II

This compound was a condensate of ethylene oxide with the product obtained by condensing propylene oxide with propylene glycol (PLURONIC® 31R1, BASF-Wyandotte, Wyandotte, Mich.).

Compound III

Compound III was a condensate similar to compound II (PLURONIC® L-10, BASF-Wyandotte, Wyandotte, Mich.).

Compound IV

This compound was a polysiloxane polyether, G-3005, supplied by Th. Goldschmidt AG, Essen, Federal Republic of Germany. The compound has the formula,

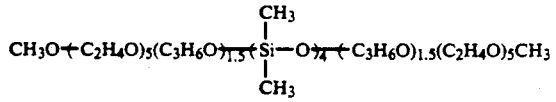

The calculated molecular weight of the compound is 866. Based on gel permeation chromatography studies (American Polymer Standards Corporation, Mentor, Ohio) relative to PDMS standards, the following average molecular weights were calculated:

| | |
|---|---|
| Weight-average molecular weight: | 880 |
| Number-average molecular weight: | 690 |
| Z-average molecular weight: | 940 |
| Polydispersity: | 1.27 |

Compound V

Compound V also was a polysiloxane polyether supplied by Th. Goldschmidt AG. The compound, designated T-5851, has the formula,

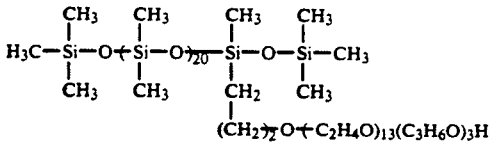

The molecular weight of the compound was 5962.

Compound VI

This compound was G-1063, also supplied by Th. Goldschmidt AG. The compound has the formula,

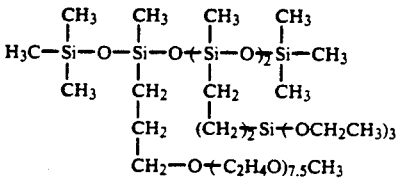

Nine additives were employed. Each additive consisted of either a single compound or a mixture of two compounds. The additives are summarized in Table 1 for those wipes having topically applied additive and in Table 2 for those wipes having additive mixed with the polymer prior to meltblowing.

TABLE 1

Summary of Examples Having Topically Applied Additives

| Example | Additive Code | Compound | Application Method | Percent Add-On |
|---|---|---|---|---|
| 1 | A | I | A | 0.8-1.0 |
| 2 | B | II | A | 0.8-1.0 |
| 3 | C | III | A | 0.8-1.0 |
| 4 | D | IV | B | 0.7 |

TABLE 2

Summary of Examples Having Additive Mixed with the Polymer Prior to Meltblowing

| Example | Additive Code | 1st Compound Cmpd. | 1st Compound Wt. % | 2nd Compound Cmpd. | 2nd Compound Wt. % | Total Wt. % |
|---|---|---|---|---|---|---|
| 5 | E | V | 3.0 | — | — | 3.0 |
| 6 | F | IV | 1.5 | V | 1.5 | 3.0 |
| 7 | G | V | 3.0 | — | — | 3.0 |
| 8 | H | IV | 2.25 | V | 0.75 | 3.0 |
| 9 | J | IV | 1.5 | VI | 1.5 | 3.0 |

The wipes of Examples 1-3, inclusive, were control wipes in that all of them employed topically applied, well-known nonionic surfactants. The wipe of Example 1 differed from the others in that upon meltblowing the polymer, it was mixed with polypropylene seed pellets containing blue pigment (SCC 4402, phthalocyanine dye supplied by Standridge Color Corporation, Social Circle, Ga. 30279) in an amount sufficient to give a pigment concentration in the web of 1.0 percent by weight. The wipe of Example 1 is available commercially as KLEEN-UPS® II wipes (Kimberly-Clark Corporation, Roswell, Ga.). The wipe of Example 4 employed a topically applied additive coming within the scope of the present invention.

The wipes of Examples 5-9, inclusive, were prepared by mixing the additive with the polymer prior to meltblowing. The additives of Examples 6-8, inclusive, come within the scope of the present invention, whereas those of Examples 5 and 9 do not.

The grease release of each wipe was determined by the test described in U.S. Pat. No. 4,587,154, which patent is incorporated herein by reference. The results of the grease release test are summarized in Table 3 for all of the wipes of the examples.

TABLE 3

Summary of Grease Release Test

| Example | Percent Grease Release |
|---|---|
| 1 | 25-30 |
| 2 | 21 |
| 3 | 23 |
| 4 | 49 |
| 5 | 30 |
| 6 | 47 |
| 7 | 47 |
| 8 | 53 |
| 9 | 23 |

From Table 3, it is evident that additives coming within the scope of the present invention impart grease release which is about twice that of the control wipes of Examples 1-3, inclusive. Moreover, such result is not dependent on the means by which additive is placed at or on the surfaces of the fibers. In addition, such additives impart grease release which also is about twice that imparted by additives outside the scope of the present invention when the latter additives are used alone, i.e., without an additive coming within the scope of the present invention.

In view of the differences in grease release between the control wipe of Example 1 and the wipes coming within the scope of the present invention, it was of interest to measure a number of properties other than grease release which are considered standard for commercially available wipes. The measured values are summarized in Tables 4 and 5 for the control wipe of Example 1 and the wipes of Examples 6-8, inclusive.

TABLE 4

Summary of Standard Wipe Properties, Part 1

| Wipe | Bulk (mm) | Basis Wt. ($g/m^2$) | Oil Capacity ($g/ft^2$) |
|---|---|---|---|
| Example 1 | 0.74 | 73 | 30.7 |
| Example 6 | 0.71 | 76 | 30.7 |
| Example 7 | 0.71 | 76 | 30.4 |
| Example 8 | 0.69 | 76 | 30.5 |

TABLE 5

Summary of Standard Wipe Properties, Part 2

| Wipe | Water Rate (sec.) | Water Capacity ($g/ft^2$) | Water Sink Rate (sec.) | Lint Count[a] |
|---|---|---|---|---|
| Ex. 1 | 2.43 | 33.3 | 1.20 | 493 |
| Ex. 6 | 2.40 | 33.4 | 1.24 | 430 |
| Ex. 7 | 2.40 | 33.3 | 1.19 | 430 |
| Ex. 8 | 2.34 | 33.6 | 1.10 | 430 |

[a]Number of particles smaller than 0.5 micron.

The properties summarized in Table 4 and 5 are described briefly below.

Bulk

Bulk is simply the measured average thickness of the wipe under a standard compression load. It was measured as described in U.S. Pat. No. 4,906,513, supra.

Basis Weight

Basis weight is the average weight or mass of the wipe per unit area. It typically is expressed as either ounces per square yard or grams per square meter ($g/m^2$).

Oil Capacity

Oil capacity is a measure of the oil-holding capacity of a wipe. It was determined as described in U.S. Pat. No. 4,906,513, supra.

Water Rate

Water rate is the average time for water to wick to a height of 5 cm when the wipe is held vertically with one edge immersed in water.

Water Capacity

Water capacity is a measure of the water-holding capacity of a wipe. It was determined as described in U.S. Pat. No. 4,906,513, supra.

Water Sink

Water sink is the time required for the wipe to wet completely when placed on the surface of a container of water. It was measured as described in U.S. Pat. No. 4,906,513, supra.

Lint

Lint, the number of particles smaller than 0.5 microns in a wipe having a standard area, was measured as described in U.S. Pat. No. 4,328,279, supra.

It is instructive to note that, based on the data in Tables 4 and 5, the wipes of the present invention of Examples 6-8, inclusive, and the control wipe of Example 1 are virtually indistinguishable. Consequently, the substantial differences in grease release between the wipes of the present invention and the control wipe were surprising and unexpected since the other properties of the wipes were so similar.

Having thus described the invention, numerous changes and modifications thereof will be readily apparent to those having ordinary skill in the art without departing from the spirit or scope of the invention.

What is claimed is:

1. A nonwoven wipe having improved grease release which comprises a meltblown polyolefin web having a basis weight of from about 17 to about 204 $g/m^2$, in which:

A. said meltblown polyolefin web has at or on the surfaces of the fibers thereof at least one additive having the general formula,

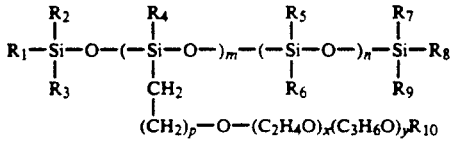

in which:

(1) $R_1$-$R_9$ are independently selected monovalent $C_1$-$C_3$ alkyl groups;

(2) $R_{10}$ is hydrogen or a monovalent $C_1$-$C_3$ alkyl group;

(3) m represents an integer of from 1 to about 4;

(4) n represents an integer of from 0 to about 3;

(5) the sum of m and n is in the range of from 1 to about 4;

(6) p represents an integer of from 0 to about 5;

(7) x represents an integer of from 1 to about 10;

(8) y represents an integer of from 0 to about 5;

(9) the ratio of x to y is equal to or greater than 2;

(10) said additive has a molecular weight of from about 350 to about 1,400; and

(11) said additive is present in an amount of from about 0.5 to about 5 percent by weight, based on the amount of thermoplastic polyolefin; and B. said wipe has been pattern bonded by the application of heat and pressure in the ranges of from about 80° C. to about 180° C. and from about 150 to about 1,000 pounds per linear inch, respectively, employing a pattern with from about 10 to about 250 bonds/inch$^2$ covering from about 5 to about 30 percent of the wipe surface area.

2. The nonwoven wipe of claim 1, in which said polyolefin is polypropylene.

3. The nonwoven wipe of claim 1, in which each of $R_1$-$R_4$ and $R_7$-$R_9$ is a methyl group and $R_{10}$ is either hydrogen or a methyl group.

4. The nonwoven wipe of claim 1, in which m is either 1 or 2.

5. The nonwoven wipe of claim 1, in which p is either 1 or 2.

6. The nonwoven wipe of claim 5, in which p is 2.

7. The nonwoven wipe of claim 1, in which y is 0 and x is either 7 or 8.

8. The nonwoven wipe of claim 1, in which said additive has a molecular weight of from about 350 to about 700.

9. The nonwoven wipe of claim 8, in which said additive is present in an amount of from about 1.0 to about 3.0 percent by weight, based on the amount of thermoplastic polymer.

10. The nonwoven wipe of claim 1, in which said meltblown polyolefin web is comprised of microfibers having average diameters of no more than about ten microns.

11. The nonwoven wipe of claim 1, in which said additive has the general formula,

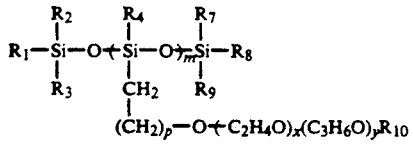

in which each of $R_1$-$R_4$, $R_7$-$R_9$, m, p, x, and y are as already defined.

12. The nonwoven wipe of claim 1, in which said meltblown polyolefin web is prepared from a surface-segregatable, melt-extrudable thermoplastic composition which comprises at least one thermoplastic polyolefin and at least one additive having the general formula,

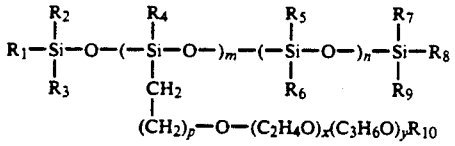

in which:

(1) $R_1R_9$ are independently selected monovalent $C_1$-$C_3$ alkyl groups;

(2) $R_{10}$ is hydrogen or a monovalent $C_1$-$C_3$ alkyl group;

(3) m represents an integer of from 1 to about 4;

(4) n represents an integer of from 0 to about 3;

(5) the sum of m and n is in the range of from 1 to about 4;

(6) p represents an integer of from 0 to about 5;

(7) x represents an integer of from 1 to about 10;

(8) y represents an integer of from 0 to about 5;

(9) the ratio of x to y is equal to or greater than 2;

(10) said additive has a molecular weight of from about 350 to about 1,400; and

(11) said additive is present in an amount of from about 0.5 to about 5 percent by weight, based on the amount of thermoplastic polyolefin.

13. The nonwovon wipe of claim 12, in which said meltblown polyolefin web is comprised of microfibers having average diameters of no more than about ten microns.

14. The nonwoven wipe of claim 1, in which said meltblown polyolefin web is coated after its formation with a grease release effective amount of at least one additive having the general formula,

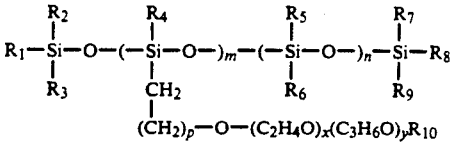

in which:

(1) $R_1$-$R_9$ are independently selected monovalent $C_1$-$C_3$ alkyl groups;

(2) $R_{10}$ is hydrogen or a monovalent $C_1$-$C_3$ alkyl group;

(3) m represents an integer of from 1 to about 4;

(4) n represents an integer of from 0 to about 3;

(5) the sum of m and n is in the range of from 1 to about 4;

(6) p represents an integer of from 0 to about 5;

(7) x represents an integer of from 1 to about 10;

(8) y represents an integer of from 0 to about 5;

(9) the ratio of x to y is equal to or greater than 2;

(10) said additive has a molecular weight of from about 350 to about 1,400.

15. The nonwoven wipe of claim 14, in which said meltblown polyolefin web is comprised of microfibers having average diameters of no more than about ten microns.

16. The nonwoven wipe of claim 14, in which said at least one additive is present at an add-on level of from about 0.3 to about 1.5 percent by weight.

* * * * *

UNITED STATES PATENT AND TRADEMARK OFFICE

CERTIFICATE OF CORRECTION

PATENT NO. : 5,085,920

DATED : February 4, 1992

INVENTOR(S) : Ronald S. Nohr
J. Gavin MacDonald

It is certified that error appears in the above-identified patent and that said Letters Patent is hereby corrected as shown below:

Column 3, line 11, "surfaceactive" should read --surface-active--; line 17, "/polyoxazolineblock copolymersare" should read --/polyoxazoline block copolymers are--; line 68, "meltextrusion" should read --melt-extrusion--;

Column 9, line 3, "g/x$^2$" should read --g/m$^2$--; line 4, "g/x$^2$" should read --g/m$^2$--; line 37, "desribe," should read --described, --;

Column 10, line 32, "isooctylph-enylpoly..." should read --isooctylphenylpoly...--; line 34, "Philiadelphia," should read --Philadelphia--; line 36, "Comoound" should read --Compound--; line 41, the heading "Compound III" should be centered, rather than indented;

Abstract Item (2), "or monovalent" should read --or a monovalent--.

Signed and Sealed this

Thirteenth Day of July, 1993

*Attest:*

Michael K. Kirk

MICHAEL K. KIRK

*Attesting Officer*

*Acting Commissioner of Patents and Trademarks*